US006138992A

United States Patent [19]

Bell

[11] Patent Number: 6,138,992

[45] Date of Patent: Oct. 31, 2000

[54] WINCH PULLEY ATTACHABLE TO A MOTOR VEHICLE-MOUNTED BOX HITCH

[76] Inventor: Alvin A. Bell, 17707 Nellie Bell La., Redding, Calif. 96003

[21] Appl. No.: 09/275,009

[22] Filed: Mar. 24, 1999

Related U.S. Application Data

[60] Provisional application No. 60/082,258, Apr. 17, 1998.

[51] Int. Cl.[7] ..... B66D 1/36

[52] U.S. Cl. ..... 254/326; 254/328; 254/405; 254/413; 224/519

[58] Field of Search ..... 254/323, 325, 254/326, 328, 335, 362, 405, 409, 413, 902; 224/511, 512, 516, 519

[56] References Cited

U.S. PATENT DOCUMENTS

| | | | |
|---|---|---|---|
| 1,194,893 | 8/1916 | Stalker | 254/325 |
| 2,120,637 | 6/1938 | Van Doorne . | |
| 2,153,793 | 4/1939 | Dennis | 254/325 X |
| 2,470,242 | 5/1949 | Felsing . | |
| 2,490,772 | 12/1949 | Benner . | |
| 2,919,107 | 12/1959 | Halbrook et al. | 254/326 X |
| 4,238,116 | 12/1980 | Plante et al. . | |
| 4,778,126 | 10/1988 | Spann, Jr. . | |
| 4,881,864 | 11/1989 | Amato | 254/323 X |
| 5,054,745 | 10/1991 | Swayze et al. . | |
| 5,593,139 | 1/1997 | Julian | 254/325 |

FOREIGN PATENT DOCUMENTS

| | | | |
|---|---|---|---|
| 562159 | 6/1973 | Switzerland | 254/323 |

*Primary Examiner*—Donald P. Walsh
*Assistant Examiner*—Emmanuel M. Marcelo
*Attorney, Agent, or Firm*—Richard C. Litman

[57] ABSTRACT

A winch pulley accessory for directing the pull of a vehicle-mounted winch to move a motor vehicle in any desired direction. The pulley accessory comprises an elongated tubular member and a pulley block. The tubular member slides into a box hitch mounted on the front of a vehicle. The pulley block is attached to the end of the tubular member. The pulley block has a sheave rotatably mounted on a pin. The pulley accessory allows a front-mounted vehicle winch to pull the vehicle backwards by sliding the pulley accessory into the hitch with the pin oriented horizontally and extending the winch cable under the vehicle, or laterally by sliding the pulley accessory into the hitch with the pin oriented vertically. The pulley accessory is lightweight, easy to install, and easy to remove for transport.

15 Claims, 2 Drawing Sheets

WINCH PULLEY ATTACHABLE TO A MOTOR VEHICLE-MOUNTED BOX HITCH

CROSS-REFERENCE TO RELATED APPLICATION

This application claims the benefit of U.S. Provisional Patent Application Ser. No. 60/082,258, filed Apr. 17, 1998.

BACKGROUND OF THE INVENTION

1. Field of the Invention

The present invention relates generally to winches and pulleys, and more specifically to a winch pulley accessory which is used with a motor vehicle-mounted winch and box hitch to pull the vehicle in a desired direction.

2. Description of Related Art

Motor vehicles, particularly those traveling off-road, often get bogged down in mud, snow, ditches and the like. Since four-wheel-drive vehicles are frequently used off-road, they are particularly prone to getting stuck. If such an incident occurs in a remote area, such as on a hunting trip, help may be unavailable. For this reason many four-wheel-drive vehicles have an attached winch. The winch can be attached to a convenient fixed object, such as a tree, and used to pull the vehicle to better ground or back on a road.

Most vehicle-mounted winches are electrical, as pulling a heavy truck out of muck is very difficult work with a mechanical winch. Most electrical winches are mounted on the front of the vehicle. This position gives easier access to the vehicle's electrical system, reducing the expense of installation. A front-mounted winch also does not interfere with moving cargo in and out of the rear. Electrical winches are available which can be either front-mounted or rear-mounted, but such winches tend to be more expensive and heavier than conventional winches and require extra wiring.

A conventional front-mounted winch can only pull the vehicle forward. Attempting to pull a vehicle backwards or sideways with a conventional front-mounted winch leads to the winch cable bending at sharp angles where it contacts the vehicle body or frame. At best the winch jams and/or damages the vehicle; at worst the winch cable breaks. A front-mounted winch will operate properly only when pulling toward a fixed object within a fairly narrow range of pulling angles toward the front. This can be very inconvenient when no fixed objects are available in suitable positions, or when the best way out is backwards or sideways.

Unfortunately, vehicles typically get into trouble front first, so that the best way out most often is backwards or sideways. For example, a truck stuck with its front wheels in a roadside ditch is not likely to get back on the road by being pulled forward.

The teachings of related art patents will now be discussed in detail.

U.S. Pat. No. 5,593,139 by Julian discloses a device for connecting a winch to a box hitch in various orientations. This device is capable of pulling a vehicle in various directions. However, the device involves attaching a winch to the end of a long tubular member attached to the box hitch. Use requires lifting the full weight of the winch, in addition to the weight of the connector. The winch-connector combination is bulky and awkward to transport. The winch can be easily damaged if the combination is allowed to roll around during transport.

Julian's device cannot be used at all with the conventional front-mounted electrical winch typically found on four-wheel-drive vehicles. Julian's device requires a portable winch to be attached to the connector. Any electrical winch used with Julian's device would have to be connected to the vehicle engine by wiring extending the full length of the tubular member. The connection would have to be either detachable or fabricated on the spot. Either type of connection would be easily damaged in use. Making the connection would require time and would be very difficult in bad weather or at night. Due to these difficulties, Julian's approach is practical only with a mechanical winch.

U.S. Pat. No. 2,470,242 to Felsing discloses a lift attachment for trailer drawbars having a winch-like device driven by a worm gear. U.S. Pat. No. 2,490,772 to Benner shows a fork lift truck which can be converted into a crane by an adapter mounting a first pulley to the forks, a second pulley to the top of the uprights, and a winch mounted on the rear of the truck, the winch cable being routed under the truck, over the second pulley, and down over the first pulley. The device is for lifting objects, not pulling the fork lift truck laterally.

U.S. Pat. No. 2,120,637, issued Jun. 14, 1938 to H. J. Van Doorne, shows a coupler for attaching ordnance to the rear of a tractor which includes a winch whose cable is guided over pulleys. The coupler permits the load to be taken off the winch cable while relocating the tractor without disconnecting the draw hook, and does not redirect the pulling direction of the winch.

U.S. Pat. No. 4,238,116, issued Dec. 9, 1980 to Plante, et al., teaches a device for pulling logging tractors, known as skidders, out of ruts. The skidder is normally equipped with a winch in the rear having a winch idler pulley. The device includes front and rear jacks having a plurality of horizontally and vertically oriented rollers. The skidder may be pulled forward by routing the winch cable over the idler pulley, under one of the horizontal rollers in the rear jack, under the skidder, under the horizontal roller in the front jack, and tying the cable around a tree. The vertical rollers help if the tree is at an angle.

With regard to the device in Plante, it is noted that (1) the winch is mounted in the rear of the vehicle; (2) the device depends upon a winch idler pulley mounted on a boom type crane; (3) the rollers have no groove to guide the cable, so that there is a possibility that the winch cable may become wedged between the horizontal and vertical rollers during the pulling operation; and (4) the device is not designed for pulling the skidder sideways, the vertical rollers being of smaller diameter; and (5) the jacks are not adapted for mounting on cars, pickup trucks, and other conventional vehicles.

Less relevant are devices which adapt the drive wheels of the vehicle to serve as a winch, such as those described in U.S. Pat. No. 4,778,126, issued Oct. 18, 1988 to C. D. Spann, Jr., and U.S. Pat. No. 5,054,745, issued Oct. 8, 1991 to Swayze, et al.

None of the above inventions and patents, taken either singly or in combination, is seen to describe the instant invention as claimed.

SUMMARY OF THE INVENTION

The present invention is a winch pulley accessory. The winch pulley accessory is used with a motor vehicle-mounted winch and a motor vehicle-mounted box hitch. Preferably the winch and the box hitch are mounted on the front of the vehicle, with the box hitch below the winch. However, the pulley accessory may be attached to a box hitch installed anywhere on a vehicle. The winch is preferably an electric winch, but may be a mechanical vehicle-mounted winch. Typical winches for use with the pulley accessory would be Warn and Ramsey's 8,000, 10,000, and 12,000 lb. electric winches.

The pulley accessory can direct the pull of a winch to pull a motor vehicle in any desired direction. The pulley accessory allows a front-mounted winch to pull backwards and sideways, either left or right, a full 360 degrees. The pulley accessory also allows the winch to pull upward when necessary to lift the front of the vehicle off the ground. This can be helpful for emergency repairs.

With the pulley accessory, a front-mounted winch can be used to free a stuck vehicle even if suitable fixed objects are located only to the side or the back of the vehicle. The pulley accessory does not reduce the pulling power of the winch in any direction. The pulley accessory can withstand the same force as the winch or the cable in any direction. The pulley accessory greatly increases the flexibility and the value of a front-mounted vehicle winch for freeing stuck vehicles. The extra expense and complexity of a rear-mounted electrical winch or of mounting both front and rear winches can be avoided. The combination of a front-mounted winch, a front-mounted box hitch, and the pulley accessory provides an inexpensive and versatile system for freeing a bogged down vehicle.

The pulley accessory is light in weight and easy for anyone to lift into position or remove after use. No tools at all are necessary for installation or removal. Proper installation is easy even for a person lacking in mechanical aptitude. Due to its simplicity, the pulley accessory is easily used at night or in bad weather.

The pulley accessory is mechanically very simple and inexpensive to produce. It is also very rugged. It requires no special protection during transport, but can simply be thrown behind a seat, in a toolbox, or in the back of a truck. The compact shape, without awkward protrusions, also makes it easy to store in the vehicle so that it is readily available when needed.

The winch pulley accessory comprises an elongated tubular member and a pulley block fixedly attached to the tubular member. The winch cable passes through the shell and over the sheave. The shell keeps the winch cable in place over the pulley during use, the groove defined in the sheave serving to guide the cable. The shell also protects the pulley from damage during transport. The pulley directs the winch cable in the desired direction. The tubular member is used to mount the winch pulley accessory to the vehicle and holds the pulley block far enough away from the vehicle so that the winch cable never has to bend at a sharp angle. The winch and winch cable are prevented from jamming and breaking, no matter what direction the winch is pulling.

The winch pulley accessory is very easy to install, requiring only sliding the tubular member into the box hitch. It is equally easy to remove by pulling it out of the hitch. Installation and removal take only seconds to accomplish. The entire process of freeing a stuck vehicle with the winch pulley accessory can be completed by one person in a few minutes.

Since the pulley accessory is not used when the winch pulls forward, it is generally unnecessary to secure the tubular member in the box hitch. Even in situations where a vehicle is stuck at an angle, with the front lower than the rear, friction is generally adequate to keep the pulley accessory in place. If a more secure attachment is needed, the tubular member may be provided with holes to admit a pin passing through matching holes in the box hitch.

The pulley accessory has two possible positions, one with the longitudinal axis through the pulley pin vertical, the other with the axis horizontal. The vertical position is best for a sideways pull. The horizontal position is best for a backwards pull or an upwards pull. For a forwards pull the pulley accessory need not be used, as a front-mounted winch functions adequately in this direction. To switch the pulley accessory from the horizontal to the vertical position, all that is necessary is to pull the pulley accessory out of the box hitch, turn it 90 degrees, and slide it back into the hitch. Due to the pulley accessory's light weight and compact design, this is easily accomplished by one person in a few seconds.

The elongated tubular member has an approximately square cross-section. The tubular member removably attaches the pulley accessory to the box hitch. The tubular member is preferably between 7 inches and 30 inches in length along its longitudinal axis, most preferably 18 inches. Preferably the tubular member has a width and a height of about 2 inches. The tubular member has four walls, making it square in cross-section. The tubular member has a hitch end and a pulley end. The tubular member slides into the box hitch at the hitch end and is attached to the pulley block at the pulley end. The longitudinal axis of the tubular member extends from the hitch end to the pulley end.

The four walls of the tubular member may each have a hole, with the two pairs of holes axially aligned. This allows the pulley accessory to be securely attached to the box hitch if necessary by passing a pin through a pair of holes and simultaneously through pin receiving holes on the box hitch.

The shell of the pulley block includes a strap having an attachment end, a free end, a first side, and a second side. The attachment end of the strap is attached to the tubular member at the pulley end of the tubular member. The pulley block preferably has a length of about 11 inches, a width of about 3¾ inches, and a height of about 3 inches.

The sheave is rotatable about a pin. The pulley accessory is attached to the box hitch so that the longitudinal axis of the pin extends in a direction approximately perpendicular to the desired direction of vehicle movement.

The tubular member and pulley block are composed of steel, aluminum, or magnesium, and possibly other metals or alloys. Preferably aluminum or magnesium is used to minimize weight. The pulley accessory is light in weight, preferably having a total weight of no more than 26 pounds, most preferably no more than 15 pounds.

The pulley accessory is used by sliding it onto a motor vehicle-mounted box hitch so that the longitudinal axis of the pin is roughly perpendicular to the desired direction of vehicle movement. Preferably the winch is an electrical winch mounted on the front of a vehicle. The draw hook and its attached winch cable are extended from the winch downward and forward to the pulley. The draw hook is passed through the swallow so that the winch cable lies in the groove of the sheave. The draw hook is then attached to a stationary object appropriately located for movement in the desired direction. The winch is then operated, moving the motor vehicle in the desired direction.

Accordingly, it is a principal object of the invention to provide a winch pulley accessory which allows a vehicle-mounted winch to pull in any desired direction, including backwards, sideways and upwards.

It is another object of the invention to provide a durable winch pulley accessory which is simple and inexpensive to manufacture.

It is a further object of the invention to provide a lightweight winch pulley accessory which can be easily transported in a vehicle and easily lifted into place, even by persons lacking in upper body strength.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a winch pulley accessory. The winch pulley accessory is used with a motor vehicle-mounted winch and a motor vehicle-mounted box hitch. The pulley accessory can direct the pull of a winch to pull a motor vehicle in any desired direction.

Figure 1:
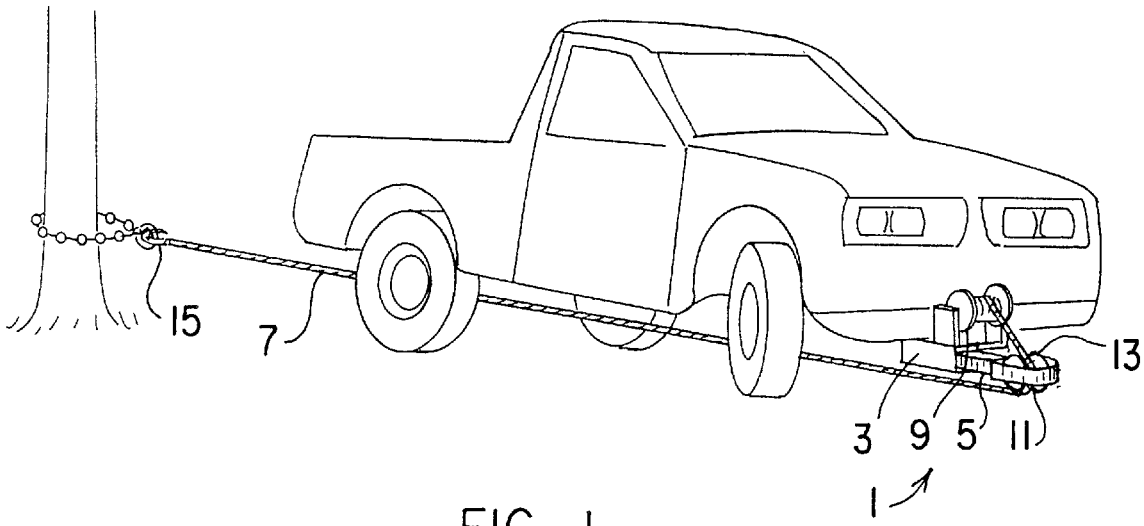
FIG. 1 is an environmental, side view of a winch pulley accessory in position to pull a motor vehicle backwards, according to the present invention.

FIG. 1 is an environmental, side view of a winch pulley accessory 1 positioned to pull a truck backwards. A conventional front-mounted winch cannot pull in this direction. The pulley accessory 1 is attached to a box hitch 3 mounted on the front of the truck. The pulley accessory 1 is attached in the horizontal position for the backwards pull, with the longitudinal axis of the pulley pin horizontal. The elongated tubular member 5 is fitted into the box hitch 3. The tubular member 5 projects forward from the vehicle far enough to minimize contact of the winch cable 7 with the vehicle body and frame.

The winch cable 7 is extended from the winch 9 through the pulley block 11 and over the sheave 13. The winch 9 is mounted on the front of the vehicle in a conventional manner, in any of several possible positions. The winch 9 is often mounted behind a grille with small rollers in the grille for the winch cable 7 to pass over. The winch 9 is preferably an electrical winch. The winch cable 7 is attached to the draw hook 15. The winch cable 7 passes under the truck. The draw hook 15 is preferably hooked to a chain looped around a fixed object. Here the fixed object is a tree. The winch cable 7 may also be looped around the fixed object and the draw hook 15 hooked to the winch cable 7. The sheave 13 preferably has a fairly large diameter to prevent bending the winch cable 7 at too great an angle.

Figure 2:
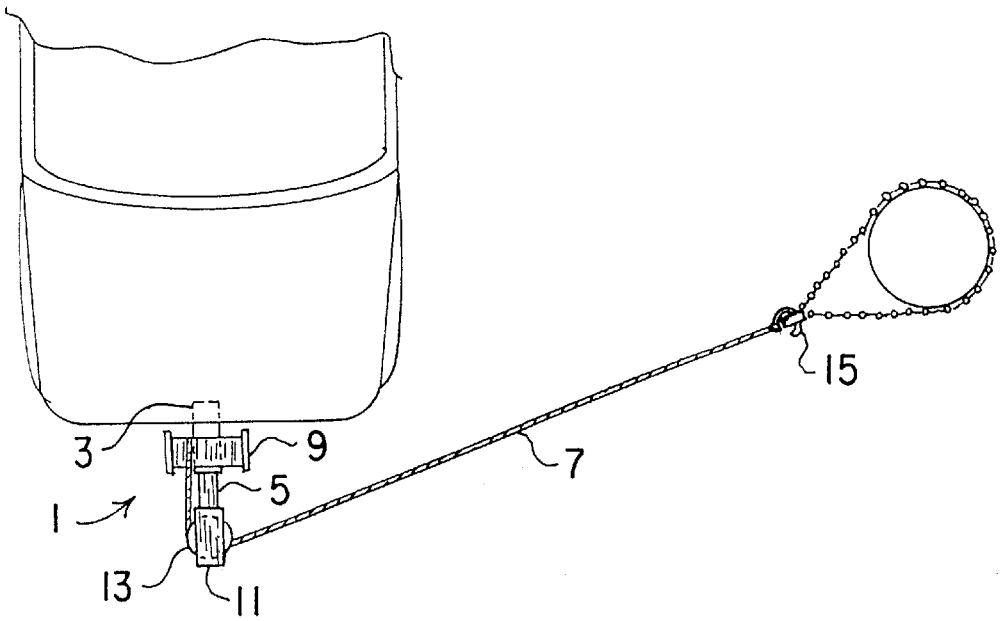
FIG. 2 is an environmental, top view of a winch pulley accessory in use to pull a motor vehicle sideways, according to the present invention.

FIG. 2 is an environmental, top view of a winch pulley accessory 1 in use to pull a truck sideways, according to the present invention. A conventional front-mounted winch cannot pull in this direction. A sideways pull has been found to be very effective in freeing stuck vehicles. The pulley accessory 1 is in the vertical position, with the longitudinal axis of the pulley pin vertical. The winch cable 7 is extended from the drum of the winch 9 and passes through the pulley block 11 and over the sheave 13. The draw hook 15 is hooked to a chain fastened around a tree.

Figure 3:
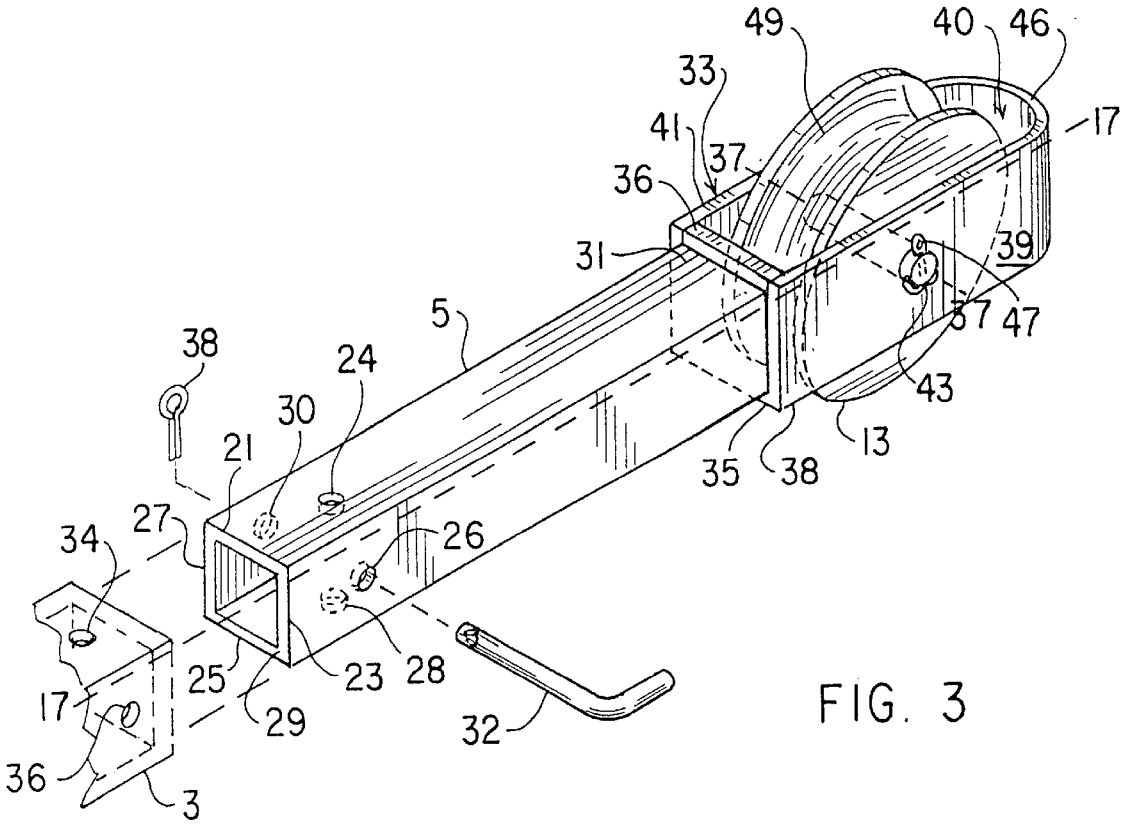
FIG. 3 is a perspective view of a winch pulley accessory according to the present invention.

FIG. 3 is a perspective view of a winch pulley accessory 1 according to the present invention. The pulley accessory 1 has a tubular member 5 and a pulley block 11.

The tubular member 5 has a longitudinal axis, line 17—17. The tubular member 5 is preferably between 7 inches and 30 inches in length along its longitudinal axis 17—17, most preferably about 18 inches. This length allows for adequate pulling angles for the winch cable while minimizing weight. The tubular member 5 is square in cross-section, with four walls 21, 23, 25, and 27 respectively. The walls of the tubular member 5 are preferably about 3/16 of an inch thick.

Width and height of the tubular member 5 preferably about 2 inches, are selected to allow the tubular member 5 to fit into the box hitch 3. The outside perimeter of the tubular member 5 is slightly smaller than the inside perimeter of the box hitch 3 so that the tubular member 5 is slidable into the box hitch 3. The fit does not have to be snug. Several types of suitable box hitches are readily available. Examples are DRAW TITE box hitches and other standard trailer hitches. Many four-wheel-drive vehicles have such a hitch mounted on the front of the vehicle for towing purposes. Otherwise, a standard box hitch may be easily installed for use with the pulley accessory 1. Class 2 and class 3 hitches are appropriate for use with the pulley accessory 1. Preferably the width and height of the tubular member 5 are about 2 inches. The tubular member 5 may include two sections having differing cross-sectional dimensions so that more than one type of box hitch can be used with the pulley accessory.

Holes may be formed through the tubular member 5 for attaching to a box hitch 3. The four holes 24, 26, 28, and 30, are formed through the four walls 21, 23, 25, and 27 of the tubular member 5. The first hole 24 and the third hole 28 are axially aligned. The second hole 26 and the fourth hole 30 are also axially aligned, but at a right angle to the axially aligned first and third holes 24, 28. This arrangement allows the tubular member 5 to be securely attached to a box hitch by means of a pin 32. The pin 32 passes through two of the axially aligned holes and simultaneously passes through pin receiving holes, such as 34 and 36, formed through the box hitch 3. The pin 32 may be secured in place with a fastener 38. The fastener 38 passes through a hole 40 oriented transversely through the pin 32, holding the pin 32 in place.

Preferably the pulley accessory 1 is simply slid into place in the box hitch 3 without securing with a pin 32. This reduces the time for installation and removal. Pin attachment might be used when it is desired to transport the pulley accessory 1 without removing it from the box hitch 3. Pin attachment might also be used where the motor vehicle is steeply inclined forward, so that the pulley accessory 1 would tend to slide out of the hitch 3. If present, four holes 24, 26, 28 and 30 are used so that the pulley accessory 1 may be attached with the pin 32 in either the horizontal or the vertical positions.

The tubular member 5 has a hitch end 29 and a pulley end 31. The longitudinal axis 17—17 of the tubular member 5 extends from the hitch end 29 to the pulley end 31. The hitch end 29 is adapted to slide into the box hitch 3. The pulley end 31 is attached to the pulley block 11, preferably by welding. The pulley end 31 and the block 11 may also be bolted together. If desired, the tubular member 5 may be strengthened by attaching an angle iron along the tubular member near the pulley end 31. The angle iron increases the stiffness of the tubular member 5 and strengthens the attachment to the block 11, without interfering with fitting the tubular member 5 into the hitch 3.

The block 11 includes a strap 33 having an attachment end 35 and a free end 46. Preferably the attachment end 35 is welded to the pulley end 31 of the tubular member 5. In the embodiment shown in the drawings, the strap 33 has been fabricated by welding a plate 36 to a U-shaped member 38. The free end 46 of the strap 33 preferably is rounded for easier and safer handling, but may be squared off. The strap 33 may be of any size appropriate to accommodate the sheave 13, provided that the swallow 40 (the gap between the groove 49 defined in the sheave 13 and the strap 33 or pulley casing or shell) is of sufficient size to allow the draw hook 15 to pass through the swallow 40. Preferably the strap 33 is about 11 inches long from the attachment end 35 to the free end 46—46, 3¾ inches wide in the direction of the longitudinal axis 37—37 of the pulley pin 43, and 3 inches high. The strap 33 has a first side 39 and a second side 41. The sides 39, 41 are preferably about ¼ of an inch thick.

The sheave 13 is rotatable about the pin 43. The pin 43 is secured transversely between the first side 39 and the second side 41 of the strap 33, and may have a bushing to reduce friction. Any standard pulley design may be used. In the embodiment shown in FIG. 3, the pin 43 extends through both sides of the strap 32 and is secured on each end of the pin 43 by a cotter pin 47.

Preferably the pin 43 has a length of about 4½ inches along its longitudinal axis 37—37, and a diameter of about 1 inch. The sheave 13 preferably has a diameter of between 4 inches and 10 inches, preferably about 7 inches and a width along the longitudinal axis 37—37 of the pin 43 of about 2¾ inches. The sheave 13 has a groove 49 which guides the cable 7 and keeps the winch cable 7 from slipping off the sheave 13 (a sheave, by definition, has a groove defined about its circumference). The groove 49 preferably is smoothly tapered with a maximum depth of about 1 inch.

Figure 4:
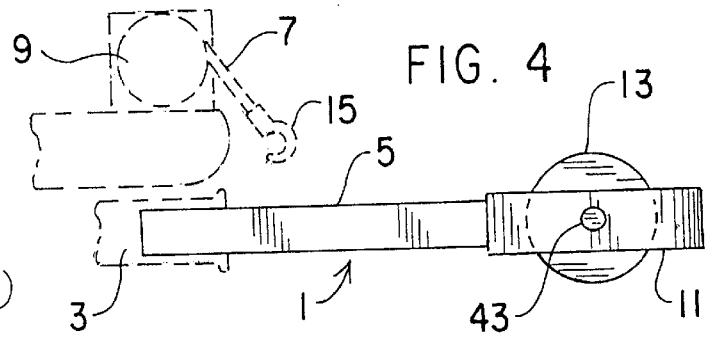
FIG. 4 is a side elevational view of the winch pulley accessory attached to a box hitch in the horizontal position, with the longitudinal axis of the pulley pin horizontal, for a backwards pull.

FIG. 4 is a side elevational view of the winch pulley accessory 1 attached to a box hitch 3 in the horizontal position, with the longitudinal axis of the pin 43 horizontal, for a backwards pull. The vehicle is shown in phantom. The winch cable 7 and the draw hook 15 extend from the winch 9. The tubular member 5 is attached to the box hitch 3.

Figure 5:
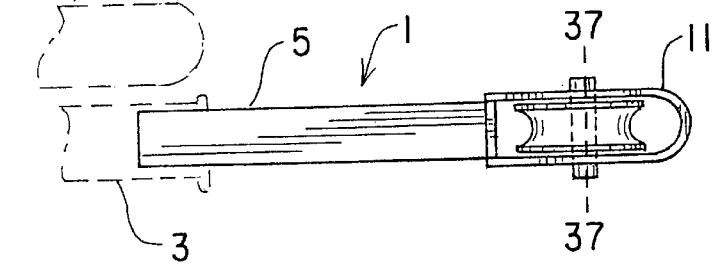
FIG. 5 is a side elevational view of the winch pulley accessory attached to a box hitch in the vertical position, with the longitudinal axis of the pulley pin vertical, for a sideways pull.

FIG. 5 is a side elevational view of the winch pulley accessory 1 attached to a box hitch 3 in the vertical position, with the longitudinal axis 37—37 of the pin 43 vertical, for a sideways pull. The vehicle is shown in phantom. The winch cable 7 and the attached draw hook 15 extend from the front-mounted winch 9. The tubular member 5 is fitted into the box hitch 3. The tubular member 5 is attached to the block 11 containing the sheave 13.

A method of moving a motor vehicle may be stated as including the steps of: (a) attaching a pulley accessory 1 to a motor vehicle-mounted box hitch 3, the pulley accessory 1 having an elongated tubular member 5 and a pulley block 11 attached to the tubular member 5, the pulley block 11 having a sheave 13 rotatably mounted on a pin 43, the pulley accessory 1 being attached to the box hitch 3 so that the pin 43 extends in a direction approximately perpendicular to a desired direction of vehicle movement; (b) extending a draw hook 15 attached to a winch cable 7 from a motor vehicle-mounted winch 9 downward and forward to the sheave 13 of the pulley accessory 1; (c) passing the draw hook 15 through the swallow 40 of said pulley block 11 so that the winch cable 7 lies in the groove 49 of the sheave 13; (d) attaching the draw hook 15 to a stationary object appropriately located for movement in the desired direction; and (e) operating the vehicle-mounted winch 9, whereby the motor vehicle is moved in the desired direction. The method may include either the step of extending the winch cable 7 from the pulley block 11 under the vehicle before attaching the draw hook 15 to the stationary object in order to pull the vehicle in a direction substantially opposite to the direction the winch cable 7 pays out from the winch 9, attaching the pulley accessory 1 with the pin 43 oriented horizontally, in order to pull the vehicle in a direction substantially opposite to the direction the winch cable 7 pays out from the winch 9, or with the pin 43 extending vertically, in order to pull the vehicle in a direction substantially lateral to the direction the winch cable 7 pays out from the winch 9.

It is to be understood that the present invention is not limited to the embodiments described above, but encompasses any and all embodiments within the scope of the following claims.

I claim:

1. A winch pulley accessory for directing the pull of a winch to move a motor vehicle in a desired direction, the winch pulley accessory comprising:

(a) an elongated tubular member of approximately square cross-section for removably attaching the pulley accessory to a box hitch, the tubular member having a longitudinal axis, the tubular member having first, second, third, and fourth walls, the tubular member having a hitch end and a pulley end, and the longitudinal axis of the tubular member extending from the hitch end to the pulley end; and (b) a pulley block, comprising:

(i) a strap having an attachment end, a free end, a first side, and a second side, the attachment end of the strap being attached to said tubular member at the pulley end of said tubular member;

(ii) a pin mounted transversely in said strap having a longitudinal axis; and (iii) a sheave rotatably mounted on said pin, the sheave having a groove defined about its circumference;

(c) wherein said pulley accessory may be mounted to a box hitch with the longitudinal axis of the pin extending in a direction approximately perpendicular to the desired direction of vehicle movement.

2. The pulley accessory according to claim 1, wherein said tubular member has a length of between 7 inches and 30 inches.

3. The pulley accessory according to claim 1, wherein said sheave has a diameter of between 4 inches and 10 inches.

4. The pulley accessory according to claim 1, wherein (a) said tubular member has a length of about 18 inches and a width and height of about 2 inches;

(b) said strap has a length of about 11 inches, a width of about 3¾ inches, and a height of about 3 inches;

(c) said pin has a length of about 4½ inches along the longitudinal axis of the pin and a diameter of about 1 inch; and (d) said sheave has a diameter of about 7 inches and a width of about 2¾ inches, the groove having a depth of about 1 inch.

5. The pulley accessory according to claim 1, wherein (a) said tubular member has first, second, third and fourth holes formed through the first, second, third and fourth walls, respectively;

(b) the first and third holes are axially aligned and the second and fourth holes are axially aligned; and (c) said tubular member is removably attached to a box hitch by an attachment pin passing through two of the axially aligned holes while simultaneously passing through pin receiving holes formed through the box hitch, whereby the attachment pin securely retains said tubular member in the box hitch.

6. The pulley accessory according to claim 1, wherein said tubular member and said pulley block are made from at least one metal selected from the group consisting of steel, aluminum, and magnesium, said tubular member and said pulley block having a total weight equal to or less than 26 pounds.

7. A device for moving a motor vehicle in any desired direction, comprising:

(a) a winch attachable to the motor vehicle;

(b) a tubular box hitch of approximately square cross-section, the hitch being attachable to the motor vehicle, the box hitch being mounted below said winch; and (c) a pulley accessory removably attached to the box hitch, the pulley accessory having an elongated tubular member and a pulley block attached to said tubular member, the pulley block having a sheave rotatable about a pin, the pin having a longitudinal axis about which the sheave is rotatable, the pulley accessory being attached to the box hitch so that the pulley block is extendible outward from the vehicle and the longitudinal axis of the pin extends in a direction approximately perpendicular to a desired direction of vehicle movement.

8. The device for moving a motor vehicle according to claim 7, wherein the winch and the box hitch are attachable to a front end of the motor vehicle.

9. The device for moving a motor vehicle according to claim 7, wherein said winch is an electrically powered winch.

10. The device for moving a motor vehicle according to claim 7, wherein said tubular member has a length between 7 and 30 inches.

11. The device for moving a motor vehicle according to claim 7, wherein said sheave has a diameter between 4 inches and 10 inches.

12. A method for moving a motor vehicle in any desired direction, comprising the steps of:

(a) attaching a pulley accessory to a motor vehicle-mounted box hitch, the pulley accessory having an elongated tubular member and a pulley block attached to the tubular member, the pulley block having a sheave rotatably mounted on a pin, the pulley block having a swallow defined therein, the pulley accessory being attached to the box hitch so that the pin extends in a direction approximately perpendicular to a desired direction of vehicle movement;

(b) extending a draw hook attached to a winch cable from a motor vehicle-mounted winch downward and forward to the pulley of the pulley accessory;

(c) passing the draw hook through the swallow of said pulley block so that the winch cable lies in the groove of the sheave;

(d) attaching the draw hook to a stationary object appropriately located for movement in the desired direction; and (e) operating the vehicle-mounted winch, whereby the motor vehicle is moved in the desired direction.

13. The method for moving a motor vehicle according to claim 12, further comprising the step of extending the winch cable from the pulley block under the vehicle before attaching the draw hook to the stationary object in order to pull the vehicle in a direction substantially opposite to the direction the winch cable pays out from the winch.

14. The method for moving a motor vehicle according to claim 12, wherein the step of attaching the pulley accessory to the box hitch includes attaching the pulley accessory with the pin oriented horizontally, in order to pull the vehicle in a direction substantially opposite to the direction the winch cable pays out from the winch.

15. The method for moving a motor vehicle according to claim 12, wherein the step of attaching the pulley accessory to the box hitch includes attaching the pulley accessory with the pin extending vertically, in order to pull the vehicle in a direction substantially lateral to the direction the winch cable pays out from the winch.

* * * * *